US005452654A

United States Patent [19]

Connell et al.

[11] Patent Number: 5,452,654

[45] Date of Patent: Sep. 26, 1995

[54] POSTAGE METERING SYSTEM WITH SHORT PAID MAIL DETERRENCE

[75] Inventors: Richard A. Connell, South Salem, N.Y.; Wallace Kirschner, Trumbull, Conn.

[73] Assignee: Pitney Bowes Inc., Stamford, Conn.

[21] Appl. No.: 90,524

[22] Filed: Jul. 13, 1993

[51] Int. Cl.[6] ..... B41J 1/60

[52] U.S. Cl. ..... 101/91; 101/109; 101/110

[58] Field of Search ..... 101/70, 71, 91, 101/287, 109, 110, 93.38; 380/23, 24, 51, 57; 400/70, 74

[56] References Cited

U.S. PATENT DOCUMENTS

| | | | |
|---|---|---|---|
| 3,978,457 | 8/1976 | Check, Jr. et al. . | |
| 4,168,533 | 9/1979 | Schwartz . | |
| 4,301,507 | 11/1981 | Soderberg et al. . | |
| 4,472,625 | 9/1974 | Lemoine . | |
| 4,493,252 | 1/1985 | Clark . | |
| 4,559,592 | 12/1985 | Muller . | |
| 4,579,054 | 4/1986 | Buan et al. . | |
| 4,673,303 | 6/1987 | Sansone et al. | 101/91 |
| 4,731,728 | 3/1988 | Muller | 364/466 |
| 4,757,537 | 6/1988 | Edelmann . | |
| 4,775,246 | 10/1988 | Edelmann . | |
| 4,780,835 | 10/1988 | Sievel . | |
| 4,796,526 | 1/1989 | Erwin . | |
| 4,796,527 | 1/1989 | Erwin . | |
| 4,813,912 | 3/1989 | Chickpeas, et al. | 364/464.02 |
| 4,864,618 | 9/1989 | Wright et al. . | |
| 4,931,943 | 6/1990 | Vermesse . | |
| 4,933,849 | 6/1990 | Connell et al. . | |
| 4,953,966 | 9/1990 | Segushi et al. . | |
| 5,012,734 | 5/1991 | Martin | 101/91 |
| 5,019,991 | 5/1991 | Sansone et al. . | |
| 5,020,429 | 6/1991 | Riley et al. . | |
| 5,075,852 | 12/1991 | Salazar et al. . | |
| 5,113,059 | 5/1992 | Brewster, Jr. | 235/101 |

OTHER PUBLICATIONS

United States Postal Service Domestic Mail Manual (DMM) DMM Issue 42, Mar. 15, 1992, pp. 393, 394 and 395.

*Primary Examiner*—Edgar S. Burr
*Assistant Examiner*—John S. Hilten
*Attorney, Agent, or Firm*—Charles R. Malandra, Jr.; Melvin J. Scolnick

[57] ABSTRACT

A postage metering system includes input means for inputting into the system a value of postage to be imprinted on a mail piece and means storing data concerning appropriate postage value amounts. A printing means is provided for printing a first postage imprint and for printing a different second postage imprint. Print control means are coupled to the printing means and the storing means for causing the printing means to print the first postage imprint for an appropriate postage value and the second postage imprint for postage value which are other than the appropriate postage raise.

14 Claims, 12 Drawing Sheets

72
POWER ON?
NO
YES
74
DIE PROTECTOR SENSOR OK?
NO
YES
76
METER MALFUNCTION DETECTED?
YES
NO
79
POSTAGE IMPRESSION DESIRED?
NO
YES
80
FUNDS ADEQUATE?
NO
YES
82
PROPER VALUE?
NO
YES
84
PARTIALY DROP DIE PROT (s)
86
RETRACT DIE PROT
88
DIE-PROTECTORS RETRACTED?
NO
YES
90
POSTAGE IMPRESSION COMPLETE?
NO
YES
92
POSTAGE IMPRESSION TIME OUT?
NO
YES
78
DIE PROTECTORS FULLY EXTENDED

POSTAGE METERING SYSTEM WITH SHORT PAID MAIL DETERRENCE

FIELD OF THE INVENTION

The present invention relates to postage metering systems, and more particularly, to a postage metering system with the ability to indicate the possibility of mail having an improper postage amount applied thereto.

BACKGROUND OF THE INVENTION

Postage metering systems print and account for postage and other unit value printing such as parcel delivery service charges and tax stamps. Some of the varied types of postage metering systems are shown, for example, in U.S. Pat. No. 3,978,457 for MICROCOMPUTERIZED ELECTRONIC POSTAGE METER SYSTEM, issued Aug. 31, 1976; U.S. Pat. No. 4,301,507 for ELECTRONIC POSTAGE METER HAVING PLURAL COMPUTING SYSTEMS issued Nov. 17, 1981; U.S. Pat. No. 4,579,054 for STAND-ALONE ELECTRONIC MAILING MACHINE issued Apr. 1, 1986; U.S. Pat. No. 4,559,592 for ELECTRONIC POSTAGE METER HAVING A SWITCHING POWER SUPPLY EMPLOYING INTEGRATED CIRCUIT TIMER issued Dec. 17, 1985; and, U.S. Pat. No. 4,953,996 for PRINT WHEEL SETTING DEVICE FOR A POSTAGE METER issued Sep. 4, 1990. Moreover, other non traditional type of meters have been developed which involve printing systems such as those employing thermal printers, ink jet printers, mechanical pin printers and other types of printing technology. Examples of this latter type of electronic postage meter are described in U.S. Pat. No. 4,168,533 for MICROCOMPUTER MINIATURE POSTAGE METER issued Sep. 18, 1979; and, U.S. Pat. No. 4,493,252 for POSTAGE PRINTING APPARATUS HAVING A MOVABLE PRINT HEAD IN A PRINT DRUM issued Jan. 15, 1985.

Because these postage metering systems print indicia and information having monetary value, the systems must be secure to protect the funds for which they account. Accordingly, various techniques have been formulated and implemented for detecting or precluding fraudulent impressions from being made and for the preclusion of printing of postage without accounting.

The electronic postage meters and mechanical postage meters which include print wheel printing mechanisms usually incorporate die protecting mechanisms as well as shrouds to prevent the "wiping" of postage off the printing mechanism. This is a type of fraud where no accounting occurs because the print wheels are utilized when the meter is inactive to obtain an impression, but with no accounting. This form of fraud is prevented by die protectors which preclude obtaining a firm and positive imprint from the print wheels even if the shrouding which is designed to prevent access to the print wheels is breached. Representative die protecting mechanisms and systems are disclosed in U.S. Pat. No 4,472,625 for SELECTABLE DECIMAL POINT FOR PRINTING DEVICE issued Sep. 18, 1984; U.S. Pat. No. 4,796,526 for VALUE PRINTING DIE PROTECTION DEVICE IN AN ELECTRONIC POSTAGE METER MACHINE issued Jan. 19, 1989; U.S. Pat. No. 4,796,527 for VALUE PRINTING DIE PROTECTION MECHANISM IN A POSTAGE METER MACHINE issued Jan. 10, 1989; and, U.S. Pat. No. 5,020,429 for DIE PROTECTION ASSEMBLY FOR PREVENTING FRAUDULENT PRINTING BY A POSTAGE meter issued Jun. 4, 1991.

Additionally, other systems have been developed particularly for non standard printing technology to help avoid fraudulent imprints. An example of one technique of this type is disclosed in U.S. Pat. No. 4,933,849 for SECURITY SYSTEM FOR USE WITH AN INDICIA PRINTING AUTHORIZATION DEVICE issued Jun. 12, 1990, wherein the indicia printed by the meter may be down loaded to the meter and changed on various dates so that the date the impression is printed can be checked against the particular indicia. Other examples are shown in both U.S. Pat. No. 4,757,537 for SYSTEM FOR DETECTING UNACCOUNTED FOR PRINTING IN A VALUE PRINTING SYSTEM issued Jul. 12, 1988 and U.S. Pat. No. 4,775,246 for SYSTEM FOR DETECTING UNACCOUNTED FOR PRINTING IN A VALUE PRINTING SYSTEM issued Oct. 4, 1988; wherein various encryption techniques are employed to validate the postage metering system indicia.

Further techniques and arrangements for detecting or preventing various fraudulent type attacks on meter system security are disclosed in U.S. Pat. No. 4,931,943 for FRANKING MACHINE PROVIDING A PERIODIC HISTORICAL TRAIL issued Jun. 5, 1990; U.S. Pat. No. 5,075,852 for FRAUD DETECTION IN POSTAGE METER HAVING UNSECURED PRINT WHEELS issued Dec. 24, 1991; U.S. Pat. No. 4,864,618 for AUTOMATED TRANSACTION SYSTEM WITH MODULAR PRINT HEAD HAVING PRINT AUTHENTICATION FEATURE issued Sep. 5, 1989; U.S. Pat. No. 4,780,835 for SYSTEM FOR DETECTING TAMPERING WITH A POSTAGE VALUE ACCOUNTING UNIT issued Oct. 25, 1988. All of these patents deal with the issue of detecting or preventing a fraudulent postage imprints.

It has been recognized that the various postal services (as well as private carrier services), however, can also be defrauded through the short payment of mail. The short payment of mail can occur when either intentionally or unintentionally a postage meter system user imprints an improper amount of postage on a mail piece which does not meet the requirements of the postal system for the country involved. Overpayment of mail can also occur in a similar manner, as for example, by the use of wrong postal rate tables. For example, in most countries, such as the United States, the postage payment system is based on a physical characteristic of the mail piece and the class of service in which the mail piece is being delivered. In the United States, first class mail, at the present time, requires a postage payment of 29 cents for the first half ounce and 23 cents for each half ounce thereafter. Thus, for first class mail, a postage value under 29 cents would be less than the legally acceptable minimum value. Moreover a postage value of 51 cents or 73 cents or 74 cents would not be appropriate postage values for first class mail. Other examples of tables for the United States Postal Service are set forth in section 411.352 of the Mar. 15, 1992 Domestic Mail Manual (DMM). Postage payment for second class mail would be susceptible to the same type problem as first class mail. Moreover use of a first class rate table by a mailer when the second class rate table is applicable would result in overpayment by the mailer for a mail piece. There are, of course, other parameters that can be utilized such as mail piece size, or non physical parameter type characteristics for mail pieces (which should be recognized to include parcels) such as distance (ZIP code of recipient or zone of recipient) for parcel delivery services.

The above type difficulty of improper payment (whether it be under payment to the postal service or overpayment by the user), have been recognized as a problem requiring attention. The U.S. Pat. No. 5,019,991 for CERTIFIED WEIGHER-SHORT PAID MAIL issued May. 28, 1991 provides a system for certifying correctly accounted for postage payment wherein documents are fed along a document path in certain parameters for documents are determined (such as weight). A printer under control of the data processor then places a certification imprint upon the document after necessary accounting is done. The certification can be a certified weighing means for weighing mail pieces with data processing means coupled to the accounting means and the weighting means for determining postage required for mailing the mail pieces. Moreover, as disclosed in pending U.S. patent application Ser. No. 952,071 for MAIL PROCESSING SYSTEM FOR VERIFYING POSTAGE AMOUNT filed on Sep. 25, 1992, for Flavio M. Manduley and Leon A. Pintsov, and assigned to Pitney Bowes Inc.; a mail stream is run through a certifying system which puts an additional imprint on the mail piece to indicate whether or not the first impression by the user is appropriate for the particular mail pieces. Another system to help avoid improper payment is described in pending U.S. patent application Ser. No. 986,231 for POSTAGE METERING SYSTEM WITH INDICIA SELECTABLE TO COMPENSATE FOR DETECTED PRINTER DEFECTS filed on Dec. 7, 1992 for Wallace Kirschner and Arno Muller and assigned to Pitney Bowes, Inc.

While the above systems work satisfactorily for their intended purposes and provide increased security for the avoidance of postal fraud, it is desirable to provide enhanced systems further simplifying the detection of improper postage payment. Moreover, it is desirable to provide such increased security for both the more traditional mechanical printing postage meter mechanisms as well as the non-traditional postage meter printing technologies.

SUMMARY OF THE INVENTION

It has been discovered that in postage metering systems, an increased level of postage funds payment security can be achieved. Impressions from meters set to less than the minimum legal postage value or, for example, to other in appropriate values for a particular class of service and weight for any mail piece, may be difficult to distinguish from properly rated mail. This is because the mail acceptance procedure often involves only spot checking of mail or parcels and because the automated postage postal service or private carrier equipment usually does not determine the value of an imprint or the value of the imprint in relation to the controlling value parameter such as weight and/or class of mail or parcel service.

It has been discovered that by modifying the indicia resulting from value setting less than the legally accepted minimum postage value or other appropriate value to look markedly different from the normal indicia, renders such indicia easily discernible.

It has been discovered that the indicia can be markedly changed in its appearance for existing mechanical printing mechanism meters (such as print wheel or print bands), particularly where electronically controlled mechanisms are employed to accomplish this task, by adjusting the print wheel or band die protectors such that some or all of the die protectors are left extended or partially extended. This results in a meter impression in which the indicia is altered by prominent bands, words or other marks across or as part of the indicia design.

Moreover, it has been discovered that in software controlled variable printing metering systems, as for example where ink jet or thermal printing is employed, the changed image can be stored in the meters electronic memory and imprinted when the indicia value printed is less than the legally accepted minimum postage value or other appropriate value.

The present invention provides the ability to change the indicia when a postage value is imprinted which does not conform (by overpayment or underpayment) to predetermined value amounts, such as a legally accepted minimum value or other appropriate postage value, to help detect the improper payment of postage.

The present invention also provides the capability to modify both traditional mechanical and non traditional variable postage printing metering systems in a way that greatly facilitates and simplifies the detection of improper imprints.

In accordance with the present invention a postage metering system includes means for storing information of appropriate postage payment values. Printing means are coupled to the storing means and are adapted to imprint a postage value amount on a mail piece or label. The postage value amount is printed in a first manner for values which are of an appropriate value for a mail piece and in a second manner for postage values which are not of an appropriate value for the mail piece. This enables improper postage value amount printing to quickly and easily be visually detectable.

In accordance with a first aspect of the invention the first imprinted amount is a first indicia and the second imprint amount is a second indicia.

In accordance with yet a further feature of the invention the mail piece is imprinted with the particular class of service and, if desired, the date of the imprinting such that the particular appropriate postage value for the item mail piece can be determined.

In yet accordance with still a further feature of the invention a meter printing means includes a mechanism for protecting the mechanism which has at least two operative positions, one associated with a first indicia and one associated with a second indicia.

BRIEF DESCRIPTION OF THE DRAWINGS

A complete understanding of the present invention may be obtained from the following detailed description of the preferred embodiment thereof, when taken in conjunction with the accompanying drawings, wherein like reference numerals designate similar elements in the various figures, and in which.

DETAILED DESCRIPTION OF THE PREFERRED EMBODIMENT

By utilizing flexibility of variable indicia printing systems such as thermal or ink jet printing and/or by modifying traditional mechanical postage metering system, another element of deterrence previously unachieved is implemented to detect improper postage imprint. In the present systems, postage values printed, as for example, for less than a certain minimum amount (generally determined by the lowest allowable denomination for a deliverable mail piece in a given class) has the indicia graphics altered to make this fact easily visually or machine detectable. For example, a special notice such as "Adjustment" or "Correction" or other variation can be printed indicating explicitly where these have been imprinted. It should be recognized that there are instances where such values can be legitimately used, as for example in the United States, to provide additional payment in adjustment for a previously imprinted improper low postage amount or for zero value postage to correct or change the date of mailing where the mail is put into the mail stream at a later date than the original postage imprint date, necessitating a new later date to be imprinted.

The change in appearance of the meter imprint as noted above makes fraud of this type obvious to casual inspection by the postal services or others and also makes the likelihood of such detection evident to individuals who may be tempted to imprint an improper postage amounts. Although this does not necessarily address all forms of improper payment which is, of course, is dependent upon the payment rating system. The present system, however, adds another element of deterrence to the group of security features incorporated in meters to help insure proper payment of postage amounts.

Figure 1:
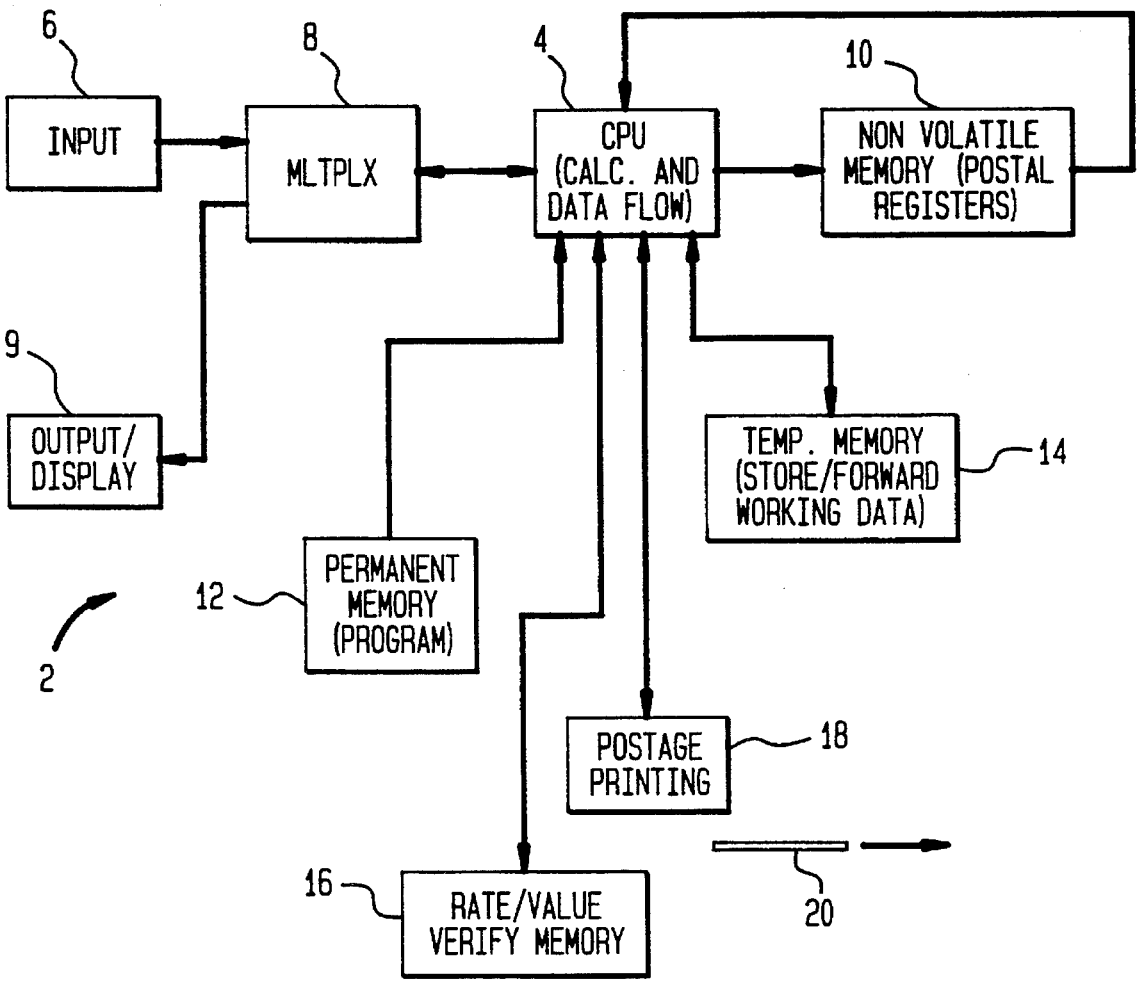
FIG. 1 is a block diagram of a postage metering system embodying the present invention wherein different indicia are printed to facilitate the detection of an improper postage value imprint.

Reference is now made to FIG. 1. An electronic postage meter shown generally at 2 includes a CPU 4 having an input 6 which may be connected to the CPU via a multiplexer 8. The input may be a keyboard or scale or other form of input for the CPU. A non-volatile memory 10 stores operating information for the meter including non-volatile register information, such as ascending and descending register information, piece count and other vital postal accounting information. The CPU 4 operates under control of programs stored in a permanent memory 12. Operating data on power up is transferred from the non-volatile memory 10 to a temporary memory 14 where data may be stored during the operation of the meter. This data is processed as the meter is operated and is transferred from the temporary memory 14 back to the non-volatile memory 10 periodically or upon power down, as desired.

An additional rate/value verification memory 16 is connected to the CPU 4. The rate/value verification memory 16 includes data concerning various postal rates for different classes of mail. For example, stored in memory 16 for U.S. postage meters would be information that the postage for a first class mail piece is 29 cents for the first half ounce. Data as to different classes of services and full rate tables may be stored in this memory. The memory 16 may also store various indicia designs associated with particular classes of service and particular postage values. This information, under program control and in conjunction with input data, are processed by the CPU 4 to cause the postage printing device 18 to print an appropriate impression on a mail piece 20 passing beneath the postage printing device 18. It should be recognized that the postage printing device 18 can be any of a number of variable printing type mechanisms such as thermal printers, pin printers, ink jet printers, bubble printers and the like. The rate/value verification memory 16 can be made part of the non-volatile memory 10 or kept as a separate non-volatile memory. Moreover, the rate/value verification memory information can be included in a meter permanent memory such as a PROM. Additionally, this information can be downloaded into the rate/value verification memory 16 if it is a memory which can be written into such as a RAM or an EAROM. The organization of the meter electronics and memories are matters of choice and can be of the above described arrangement or other suitable arrangements, as for example, systems which do not involve the temporary memory 14.

Figure 2:
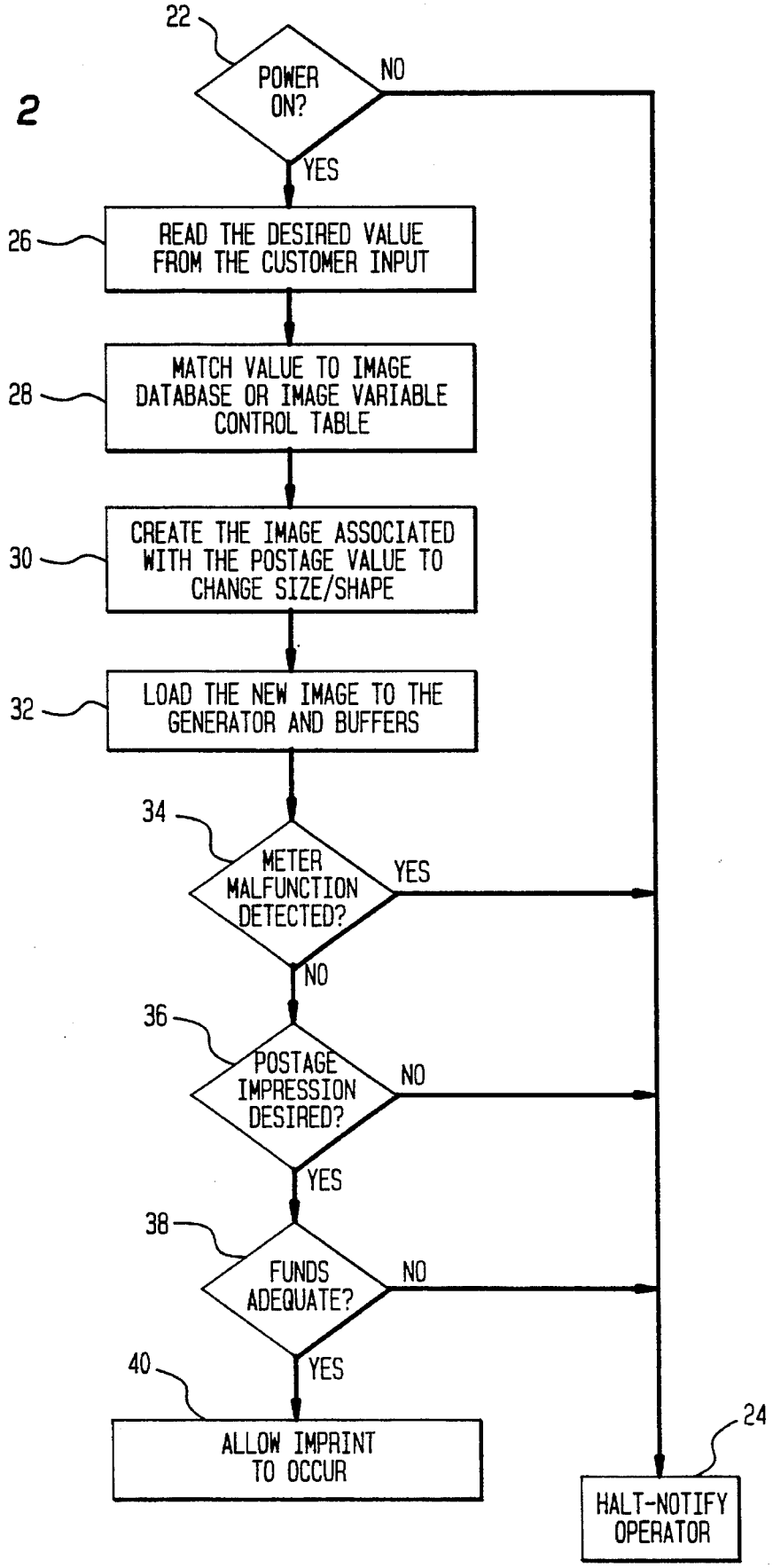
FIG. 2 is a partial flow chart of the program to control operation of the metering system shown in FIG. 1 and helpful to an understanding of the present invention.

Reference is now made to FIG. 2 which is a partial flow chart of the program adapted to control the postage metering system shown in FIG. 1. Upon power on, a decision is made, decision block 22, whether sufficient power is available. If sufficient power is not available the meter operation is halted, block 24. If sufficient power is available, however, the desired value from the customer input is read, block 26. The value is matched to the image data base or image variable control table stored in the rate/value verification memory 16, block 28.

An image associated with the postage value is created which may change size or shape or content depending upon the class of service and the value of postage input by the user, block 30. The image is loaded into the meter generator and buffers, not shown, which may be internal to the CPU, block 32. If a meter malfunction has not been detected, decision block 34, operation continues. If a malfunction is detected, the meter operation is halted and the operator is notified via the display 9, block 24. If a postage meter impression is desired, decision block 36, a determination is made whether adequate funds are present, decision block 38. If no impression is desired or alternatively no adequate funds are available, meter operation is halted, block 24. If adequate funds are present, the meter postage printing device 18 is allowed to operate and imprint an impression upon the mail piece 20, block 40.

It should be noted with respect to the information provided in FIGS. 3*a* through 3*k* and 7*a* through 7*d*, that the information is representative. What constitutes an appropriate value for a given class of service is information which is provided by the national postal services or particular private carrier. Moreover, this information changes with time as rate tables are changed and updated. The rate tables for the United States Postal Service are presented in the U.S. Domestic Mail Manual (DMM) which contains various sections concerning postage rates and fees for various classes of service. Thus, the information provided in FIGS. 3*a* through 3*k* and 7*a* through 7*d* are representative of the type of imprint and indicia changes that may be implemented. Many other changes and variations are within the scope of the present invention.

The imprinted postage meter image can be derived from the data center or from data within the meter system 2 such as, if available, clock calendar setting, addresser or addressee, zip code, meter system serial number, and other data, in addition to the noted data such as involving the class of service and the value of the input data by the operator or other source. Thus, for example, odd days of the month may have one type of image and even days have a different type of image in addition to the various changes noted hereinafter in connection with FIGS. 3*a* through 3*k*.

Figure 3A:
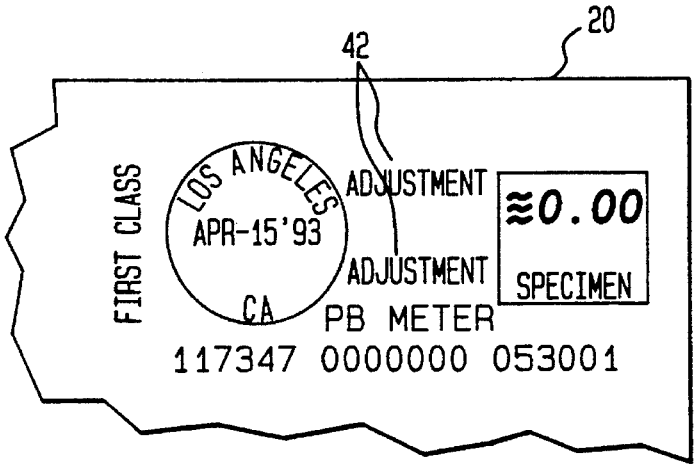
FIGS. 3*a*, 3*b*, 3*c*, 3*d*, 3*e*, 3*f*, 3*g*, 3*h*, 3*i*, 3*j* and are a series of indicias that may be imprinted by the metering system shown in FIG. 1 and illustrating indicias (both graphic and non graphic) to facilitate rapid detection of improper postage value imprints on a mail piece.
Figure 3B:
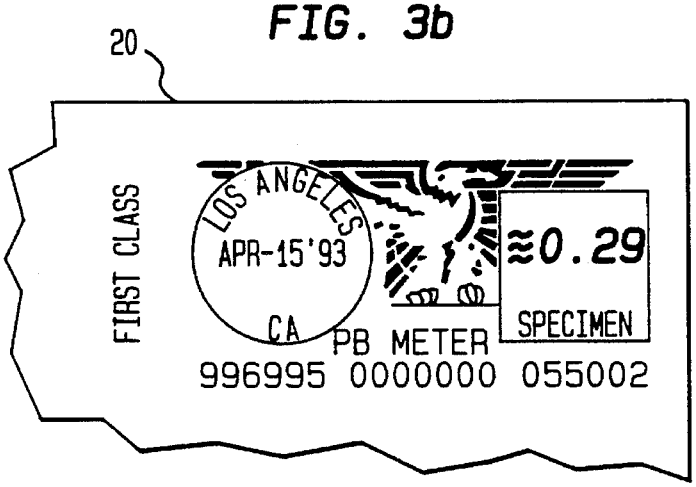

Reference is now made to FIGS. 3*a* through 3*k*. When a non-suitable value is imprinted for a particular class of service, as for example, as shown in 3*a* wherein a zero value is printed for a first class postage imprint, a clear indication that a non-suitable value has been printed is denoted by imprinting the printing means 18 by also printing the word "Adjustment" shown at 42 on the mail piece 20. As shown in FIG. 3*b* when a suitable value for a first class imprint is printed, here 29 cents, the appropriate indicia is printed (an eagle) along with the value and other information.

Figure 3C:
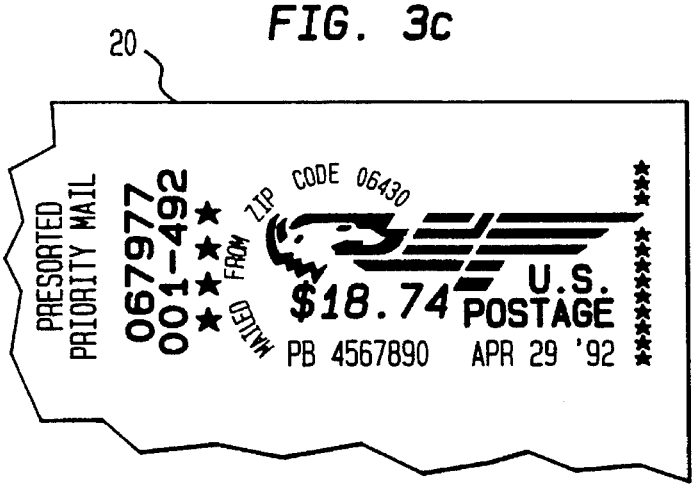
Figure 3D:
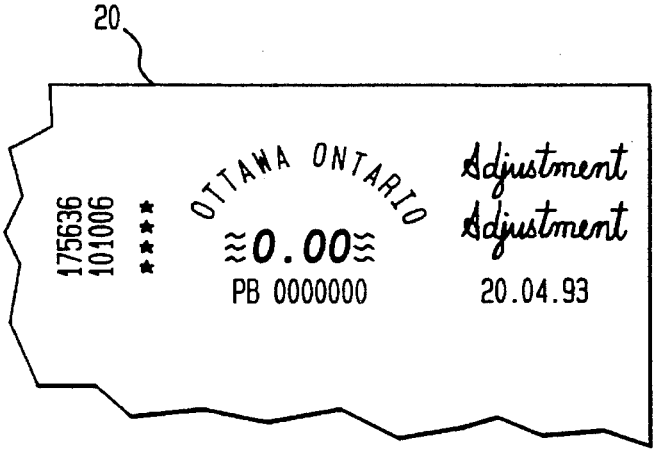

For a different class of service, as shown in FIG. 3*c*, presorted priority mail, the imprint is significantly changed in accordance with the class of service and the value input into the meter system ($18.74) . The eagle design changes as does the presentation of information imprinted on the mail piece 20. The presence of stars along the right margin of the mail piece can denote the fact that the postage value of $18.74 is an appropriate value for presorted priority mail. Depending on the selected convention and the postage rate table involved, however, the presence of stars can be made to indicate an inappropriate postage value. The system is thus very flexible as to what is changed in the imprint, when it is changed and what such change means.

Figure 3E:
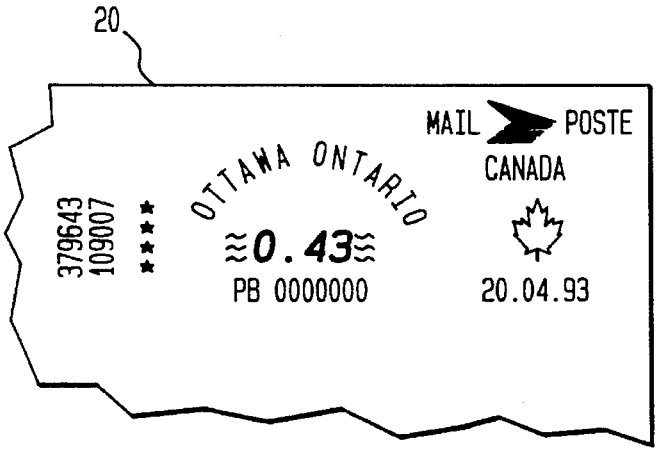
Figure 3F:
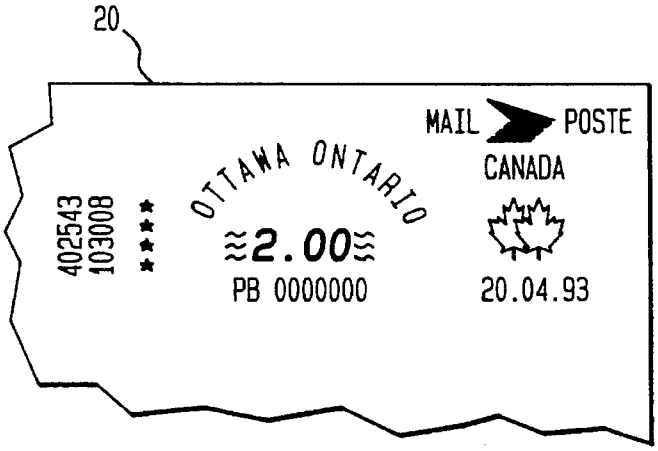
Figure 3G:
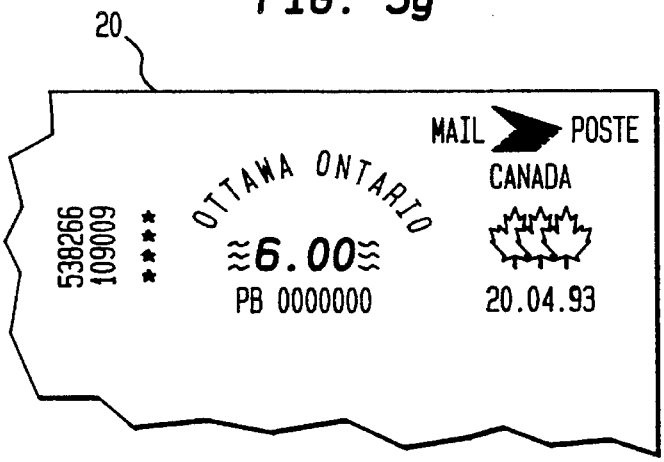

FIGS. 3*d* through 3*g* depict various alternative indicia designs suitable for the Canadian Post. These include by way of example the imprint of the word "Adjustment" in FIG. 3*d* where a zero postage value is imprinted. In FIG. 3*e* a single maple leaf is imprinted with an indicia design for a 43 cent postage imprint. In FIG. 3*f*, a two maple leaf design and also including an indicia design is imprinted. In FIG. 3*g* an imprint is shown involving a stamp having a $6.00 value with three maple leafs and an indicia design. The class of service for these various imprints can, if desired, be included as part of the imprint.

Figure 3H:
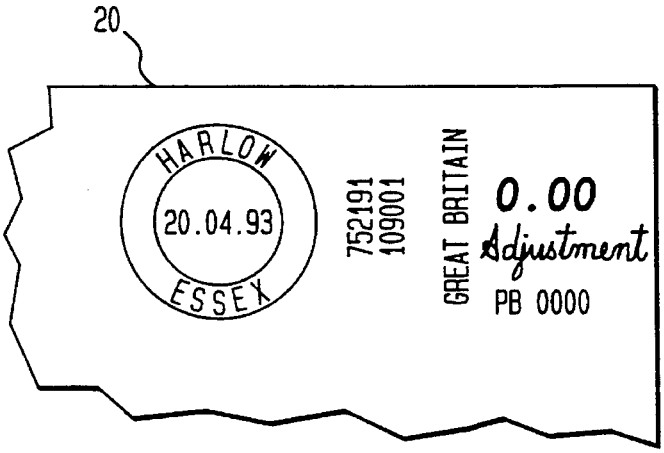
Figure 3I:
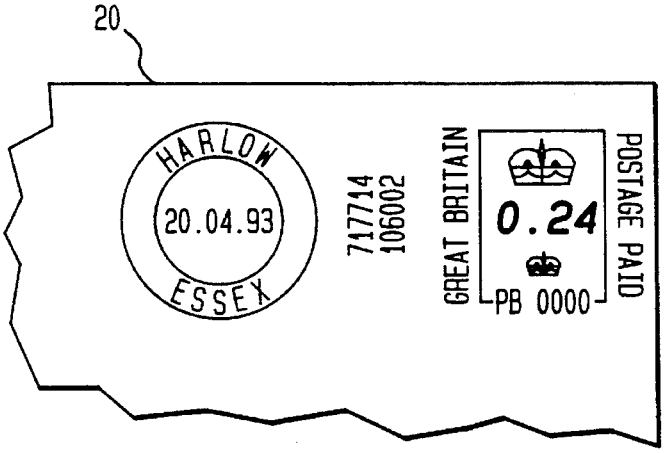
Figure 3J:
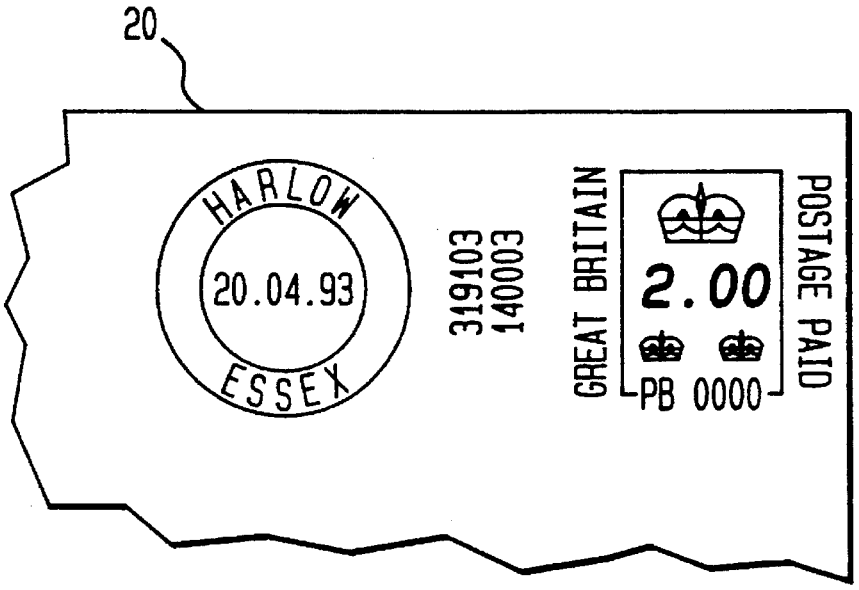
Figure 3K:
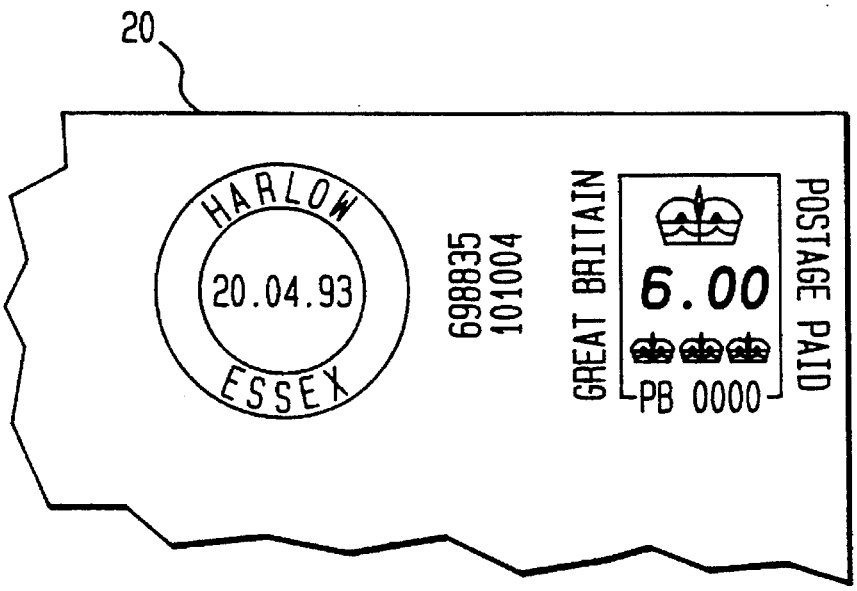

Reference is now made to FIGS. 3*h* through 3*k* which depict a series of U.K. imprints on a mail piece. For a zero pence postage imprint, the word "Adjustment" is printed as part of the meter imprint as shown in FIG. 3*h*. However, when a value such as 24 pence is printed, as shown in FIG. 3*i*, an indicia is provided involving a large crown toward the top margin of the mail piece 20 and a small crown toward the bottom of the indicia adjacent the PB meter serial number. In contrast, for a two pound imprint, as shown in FIG. 3*j*, and a six pound imprint, as shown in FIG. 3*k*, additional small crowns are included adjacent the meter serial number. In the case of FIG. 3*j* two small crowns are included, while in FIG. 3*k*, three small crowns are included. This again shows the various ways in which the meter imprint can be varied in accordance with the input value by the user. Again, this variation can be related to the class of service, if desired, which can be imprinted on the mail piece and the postage rate table.

Figure 4:
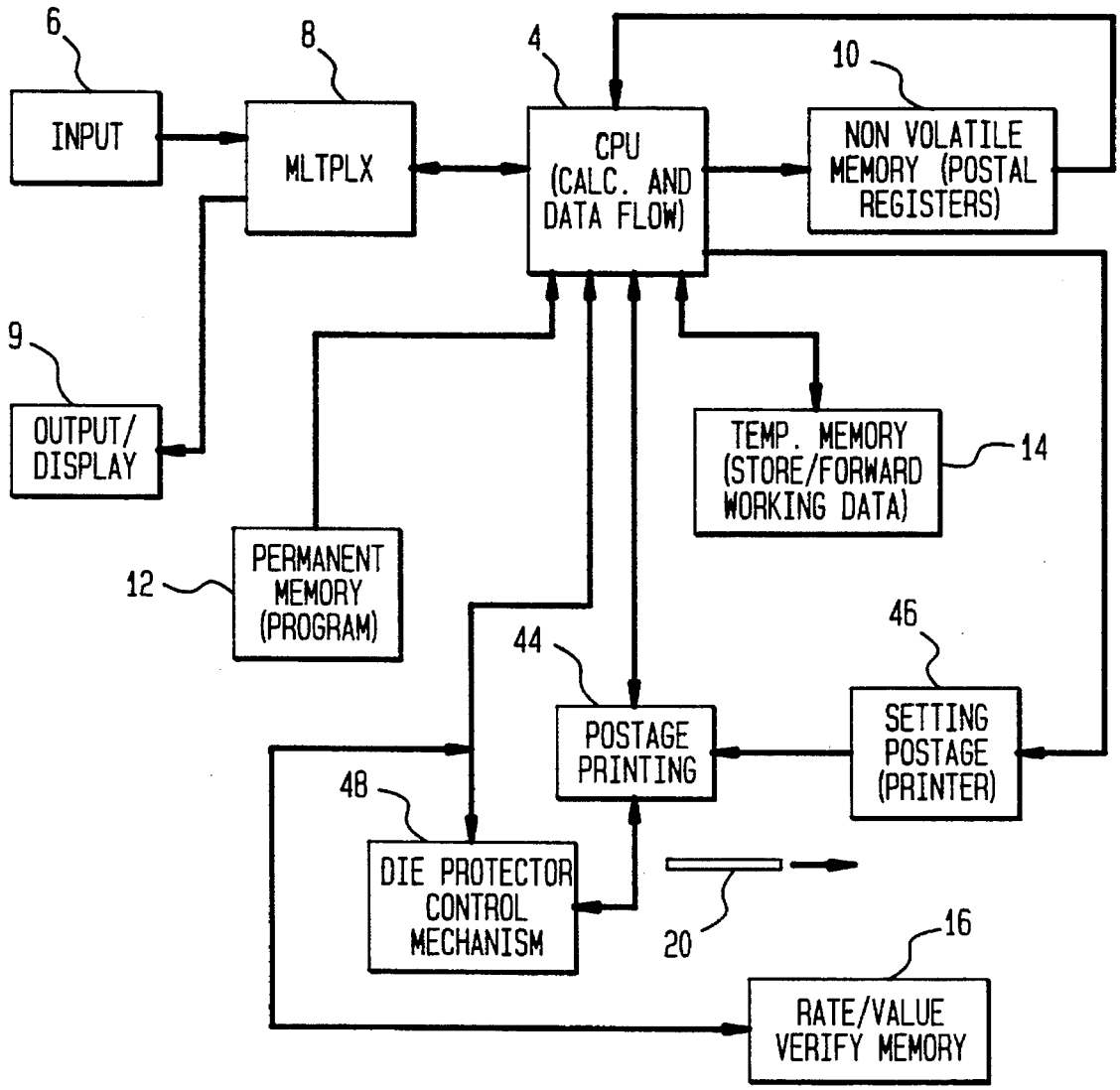
FIG. 4 is a block diagram of a postage metering system employing a mechanical printing mechanism and embodying the present invention.

Reference is now made to FIG. 4. FIG. 4 is similar to FIG. 1 except that the postage printing mechanism 44 is a mechanical device, as shown in FIGS. 5, 5*a*, 5*b* and 5*c*. The postage printing mechanism 44 is connected to a setting arrangement 46 and a die protector control arrangement 48. The setting arrangement 46 sets the postage printing mechanism print wheels or bands, as the case may be, to a desired value for imprinting. The die protector control arrangement 48 controls the die protectors, which as previously described prevent "wiping" an impression off the postage print wheels or bands.

Figure 5:
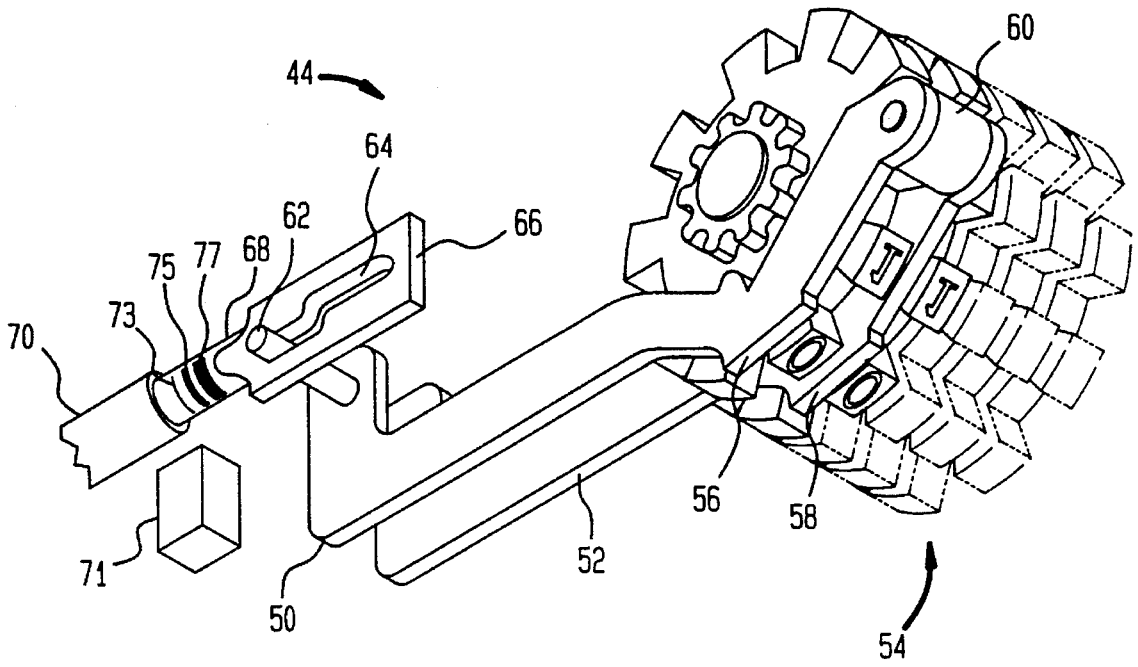
FIGS. 5, 5*b* and 5*c* are perspective views of postage metering system mechanical postage printing mechanism having moveable die protectors for printing of different indicias to facilitate rapid differentiation between proper and improper postage value imprints and showing the die protectors respectively, in the fully extended, partially extended and fully retracted positions.
Figure 5A:
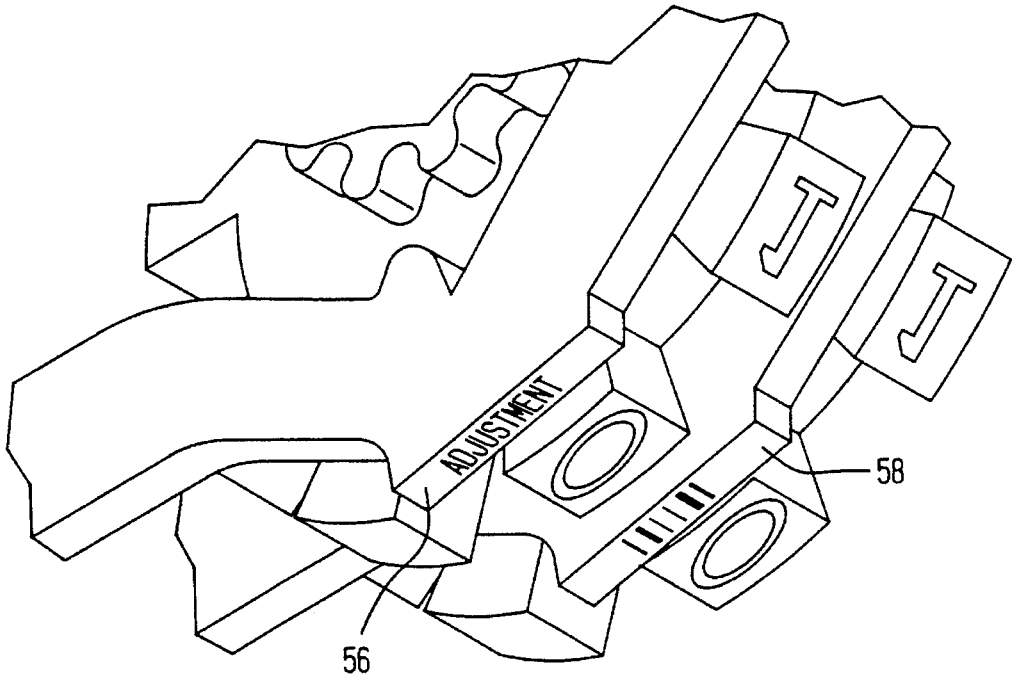
FIG. 5*a* is an enlarged partial perspective view of the bottom portion of the moveable die protectors shown in FIGS. 5, 5*b* and 5*c* helpful to an understanding of the operation of the postage printing mechanism.

Reference is now made to FIG. 5 showing the print mechanism 44 and die protectors. Two die protector blades 50 and 52 are placed adjacent to the two highest order print wheels of the print wheel banks 54. These two blades are shown in FIG. 5 positioned to protrude beyond the printing plane of the print elements to prevent the "wiping" of a fraudulent prints from the print elements. The blades are in this position when postage printing is not intended to take place. These may include particular conditions under which the meter may be disabled such as for lack of power, insufficient postage funds stored in the meter, value selection in process in which the high order print wheels are to be moved and various sensed error conditions.

Figure 5B:
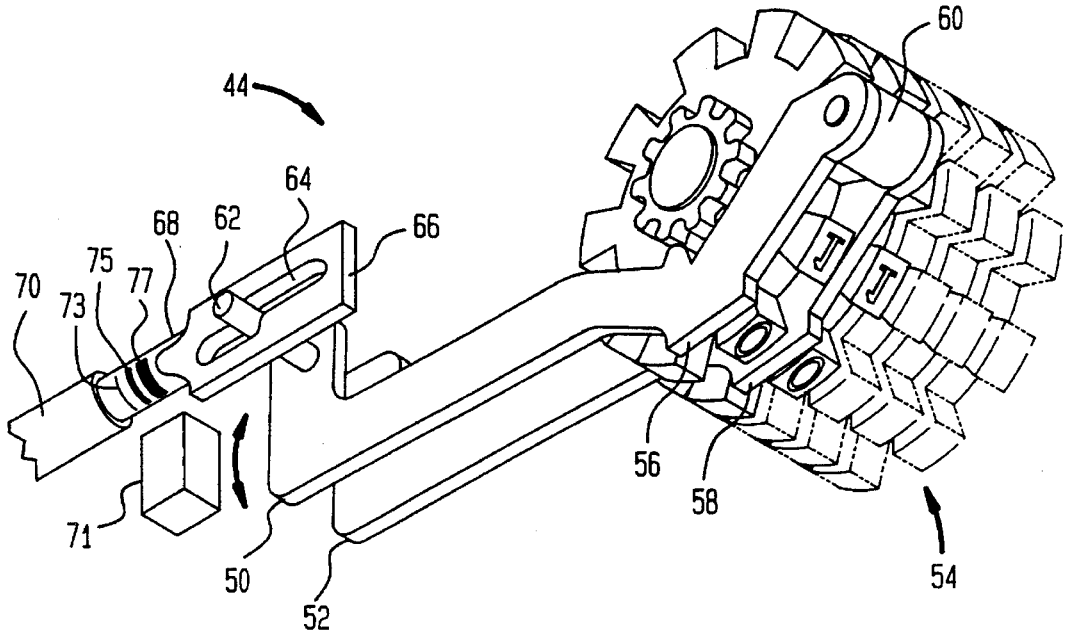

The blades 50 and 52 may each have rubber molded or die cast image on lower surfaces 56 and 58, respectively. These images are adapted to be imprinted on a mail piece when the die protector blades are partially retracted, as shown in FIG. 5*b*, such that the print wheels may still make a firm and readable impression on the mail piece 20 but further including the image information on the lower portions 56 and 58 of the die protector blades. This information can be, for example, the word "Adjustment" or the class of service and the word "Adjustment" or bar code or the like. This imprinted information provides a visual or machine readable flag to postal service or private carrier personnel that the imprint may be an improper value for the selected class of service.

As shown in FIG. 5, blades 50 and 52 are pivotally attached at shaft 60 and at the opposite ends are engaged via a pin 62 which is held in S-shaped slot 64 of member 66 to the armature 68 of solenoid 70. The solenoid 70 is under direct control of the CPU 4 via the die protector control arrangement 48. When the solenoid 70 is energized it pulls in the armature 68 and thus the member 66 against the force of a spring, not shown; so that the die protector blades can be in any of three positions, namely, fully retracted (FIG. 5*c*) , partially retracted (FIG. 5*b*) or fully extended (FIG. 5). The elevated portion of the slot 64 raises the die protector blades 50 and 52. The die protector blades 50 and 52 will remain fully retracted, as shown in FIG. 5, until the CPU 4 via the die protector control arrangement 48 deenergizes the solenoid or until power is lost which will more the die protector blades to the fully extended position.

When the die protector blades are fully or partially retracted, they may perform the function of detenting the higher order print wheels to improve their alignment. This print wheel alignment function is retained during both full and partial retraction, because of the dimensioning of the parts.

An optical sensor 71 connected to the die protector control arrangement 48 is provided for detecting the position of the die protector blades 50 and 52. This is implemented by detecting different positions of the armature 62. Marks 73, 75 and 77 in conjunction with sensor 71 provide information as to the position of the die protector blades 50 and 52. Thus, the sensor 71 provides information as to whether the die protector blades 50 and 52 are fully extended, partially extended or fully retracted. It should be recognized that other types of sensors such as magnetic sensors and feeler sensors as well as other types of positioning devices such as stepper motors can be utilized in accordance with the present invention.

Figure 5C:
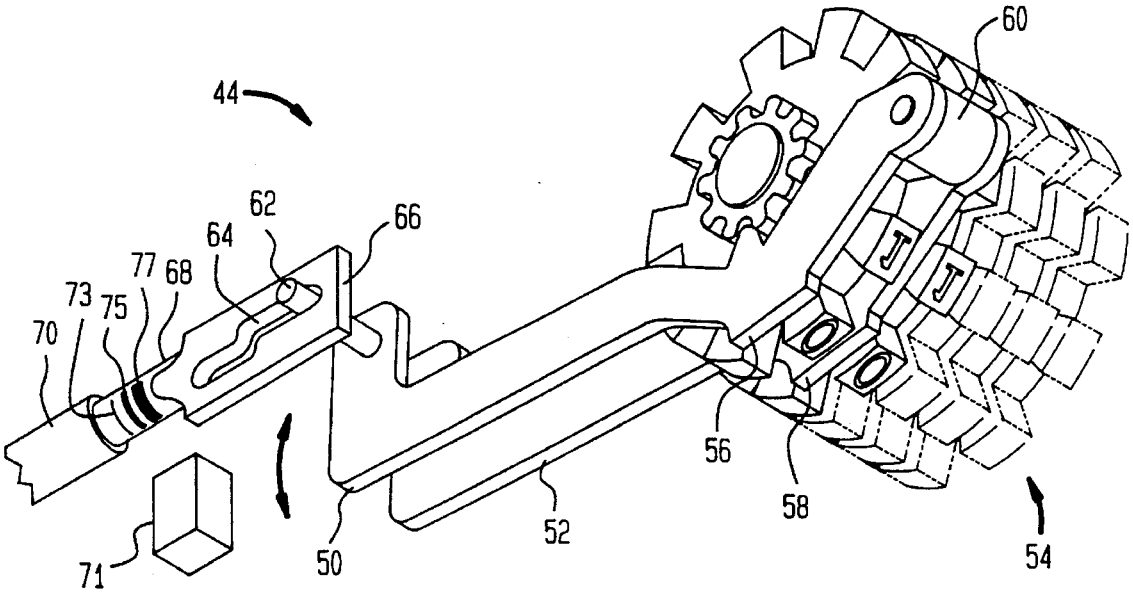

The particular die protection mechanism referenced in FIG. 5 is described in greater detail in U.S. Pat. No. 5,020,429, the full disclosure of which is hereby incorporated by reference. Numerous other die protector type mechanisms can be utilized with the present invention. Moreover, die protector blades can be provided between each print wheel or band and not just the two higher order print wheels as shown in FIGS. 5, 5*b*, and 5*c*. Each die protector blade can be made to operate separately (such as by separate solenoids) or be physically connected to other die protector blades so that they operate together via a single solenoid, such as solenoid 70.

Figure 6:
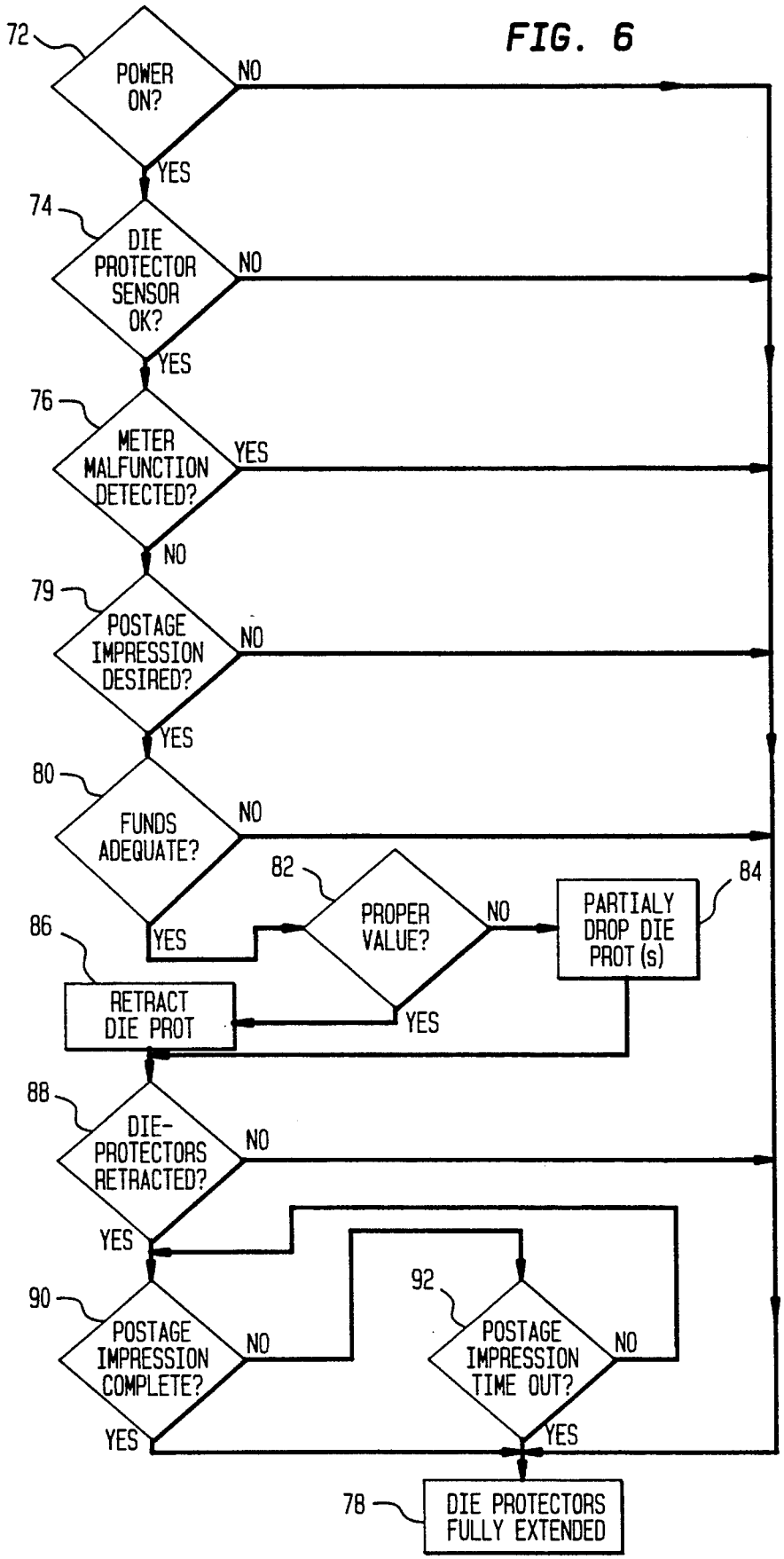
FIG. 6 is a partial flow chart of the program to control operation of the metering system shown in FIGS. 4, 5, 5*a*, 5*b*, and 5*c* and helpful to an understanding of the present invention.

Reference is now made to FIG. 6 which is a partial flow chart of the program to control the operation of the metering system shown in FIG. 4 along with its associated printing mechanism shown in FIGS. 5, 5*b* and 5*c*. Upon power on, a determination is made of the meter system, if sufficient power is available, decision block 72. A determination is then made as to whether the die protector position is appropriate for the meter condition, decision block 74. A further determination is made thereafter whether a meter malfunction has been detected, decision block 76. If the appropriate power is not sufficient or if the die protector is in an inappropriate position or if a meter malfunction has been detected, the die protector blades 50 and 52 are fully extended to cause the meter printing mechanism to be inoperable, block 78.

If no meter malfunction is detected, a determination is made whether a postage impression is desired, decision block 79. If an imprint is desired, a determination is thereafter made whether adequate funds are present, decision block 80. In either case, if a postage imprint is not desired or adequate funds are not present, the die protector blades 50 and 52 are caused to be fully extended, block 78. If the postage funds are adequate, a determination is made, decision block 82, whether a proper value, for the class of service, has been input for the postage meter system 2. If the postage value is not appropriate, the die protector blades are partially dropped (particularly retracted), block 84. If the value is proper, as determined in decision block 82, the die protector blades may be fully retracted, block 86.

It should be expressly noted that the retraction of the die protectors can be on an individual basis by providing additional solenoids and associated mechanisms and circuitry and program instruction so that the class of service may be imprinted, as for example, with or without the other die protector blades being partially retracted. This provides the ability to include a separate message or marking or not include by each die protector blade on the mail piece 20.

At decision block 88, a determination is made whether the die protector blades 50 and 52 are retracted (including partially retracted). If this is the case, a determination is made whether the postage impression should be completed, decision block 90. If, however, the die protector blades 50 and 52 are not retracted (or partially retracted) the die protector blades 50 and 52 are caused to be fully extended, block 78. If a postage impression is completed, the die protector blades 50 and 52 are again fully extended, block 78. If, however, the postage impression is not completed, a determination is made, decision block 92, whether the time for the postage impression has timed out. If time out has occurred, the die protector blades 50 and 52 are caused to be fully extended, block 78, and if not, the program is allowed to loop back to enable the impression process to continue.

Figure 7A:
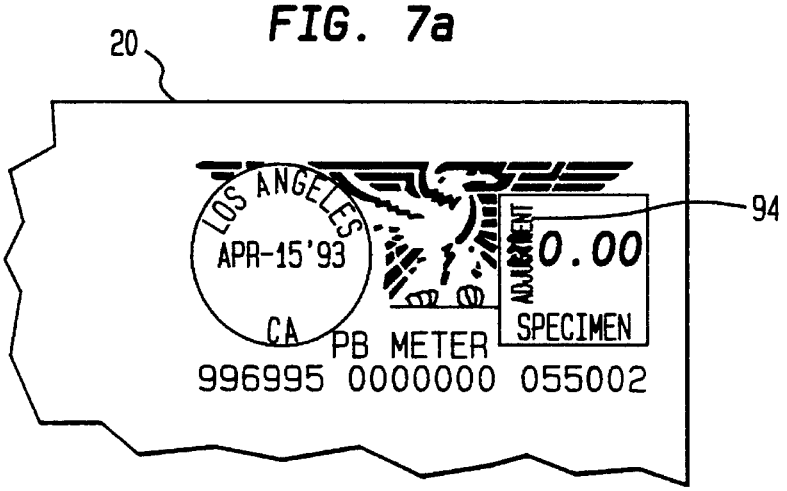
FIGS. 7*a*, 7*b*, 7*c*, and 7*d* are a series of indicias that may be imprinted by the metering system shown in FIGS. 4 and 5, 5*a*, 5*b* and 5*c* illustrating indicias to facilitate rapid detection of improper postage value imprintings on a mail piece.
Figure 7B:
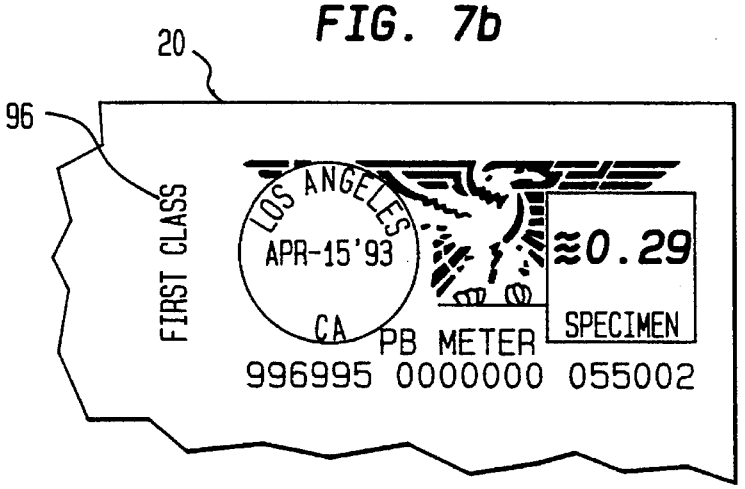
Figure 7C:
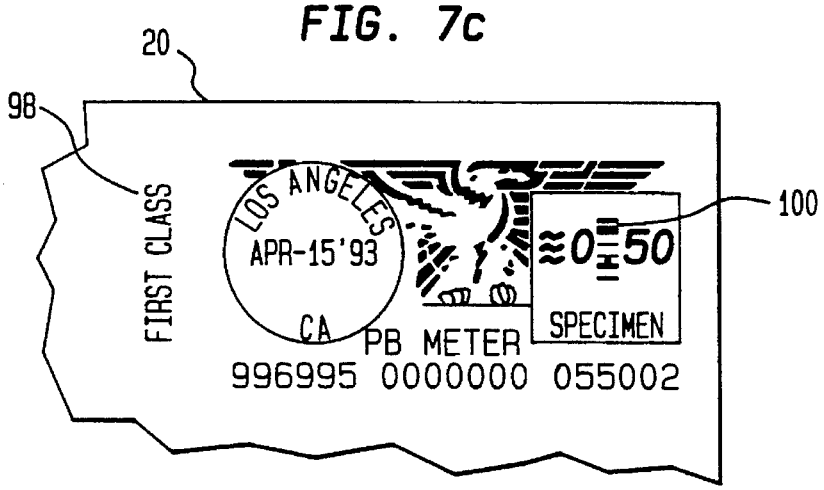

Reference is now made to FIGS. 7*a* through 7*d*. In FIG. 7*a*, a zero value is imprinted on the mail piece 20. Accordingly, the first die protector blade 56 is caused to be partially retracted and imprint the word "Adjustment" shown at 94 on the mail piece 20. This denotes that the postage value may be inappropriate. To provide a better visual indication, the word "Adjustment" can be in a different color than the indicia itself, as for example, by using a purelon material. This material is a self inking material and can form the die mounted to the lower portion 56 of the die protector blade 50. In FIG. 7*b* a 29 cent value is applied to mail piece 20. For a first class letter this postage value is appropriate. Accordingly, neither die protector blades are partially retracted. Die protector blades 50 and 52 remain fully retracted. In this case, the word "First Class" are imprinted on the mail piece at 96 by a mechanism, not shown, but which is common in many postage metering devices which require, as for example in Germany, different categories of service to be imprinted on the mail piece. This is implemented usually by a separately rotatable printing die which may be included as part of the meter system. In FIG. 7*c*, a postal value of 50 cents is imprinted on mail piece 20 with the imprint that it is a "First Class" letter at 98. Since 50 cents is less than the next rate break for a one ounce letter as currently required in the United States, the second die protector blade 52 is partially retracted causing a series of six bars to be imprinted at 100 on the mail piece 20. Again, this bar imprint can be of a different color than the indicia itself to render it more visible and along with other portions of the indicia be machine readable.

Figure 7D:
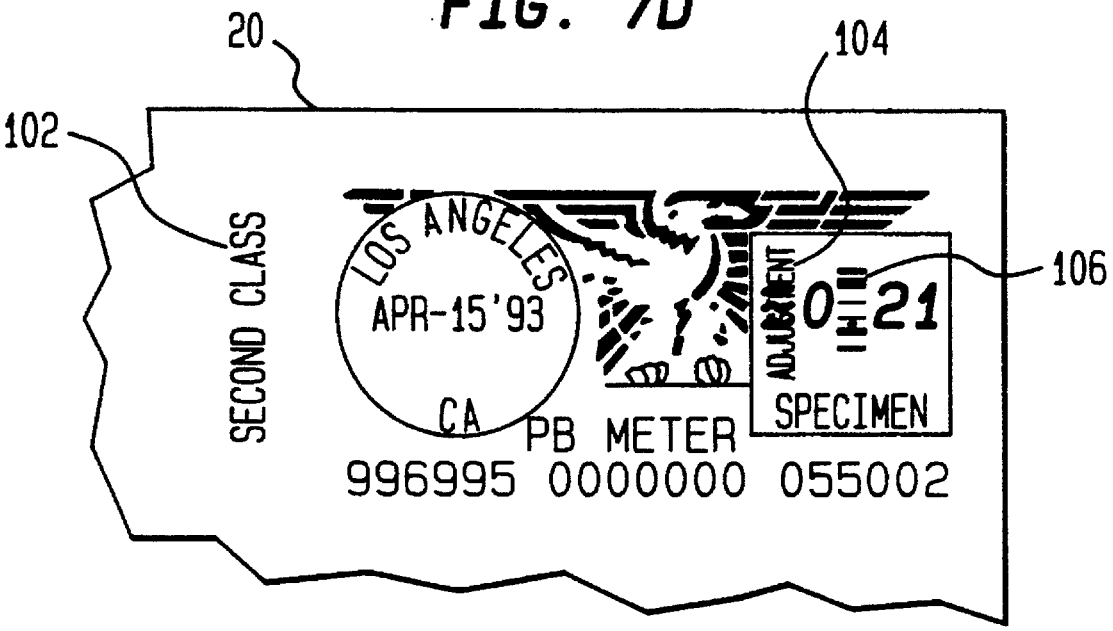

Finally, reference is made to FIG. 7*d* wherein both die protector blades 50 and 52 are partially retracted to cause the word "Adjustment" and the series of six bars to be imprinted on the mail piece 20. This is to denote that the value of 21 cents is an inappropriate value for a second class letter as denoted at 102. Thus, the word "Adjustment" is imprinted at 104 and the six bars are imprinted at 106. Similar to the previous instances, these bars and the word "Adjustment" can be imprinted in a different color ink and/or be machine readable.

The various combinations of markings such as the word "Adjustment" the bars or other markings, as well as the number, design and manner of control of the die protector blades are a matter of choice. The choice depends, in part, upon the information that is desired to be communicated to the postal service or private carrier as to the relationship between the imprinted postage value and the class of service selected. This in turn is based on the rate tables for the postal service or private carrier.

While the present invention has been disclosed and described with reference to a the disclosed embodiments thereof, it will be apparent, as noted above, that variations and modifications may be made therein. It is, thus, intended in the following claims to cover each variation and modification that falls within the true spirit and scope of the present invention.

What is claimed is:

1. A postage metering system, comprising:

input means for inputting into said postage metering system a selected postage value to be printed on a mail piece;

means for storing data of an appropriate postal rate;

printing means for printing a first postage imprint and for printing a different second postage imprint; and print control means coupled to said printing means and said storing means for causing said printing means to print said first postage imprint including the selected postage value, said print control means also printing said second postage imprint when said selected postage value is other than said stored appropriate postal rates.

2. A postage system as defined in claim 1 wherein a class of service is imprinted as part of said first postage imprint and said second postage imprint.

3. A postage metering system as defined in claim 1 where said first postage imprint is a first postage graphic pattern indicia and said second postage imprint is a second different graphic pattern indicia.

4. A postage metering system as defined in claim 2 wherein said printing means is a mechanical printing means having at least one die protector means and said second postage imprint is an imprint having at least one die protection means mark imprinted along with said first postage imprint.

5. A postage metering system as in claim 1 wherein said second postage imprint includes a legend indicating a postage value which is other than said appropriate postage value.

6. A postage metering system as defined in claim 2 where said first postage imprint is a first postage graphic pattern indicia and said second postage imprint is a second different graphic pattern indicia.

7. A postage metering system as in claim 2 wherein said second postage imprint includes a legend indicating a postage value which is other than said appropriate postage value.

8. A postage system as defined in claim 2 wherein said date of said imprint is imprinted as part of said first

9. A method for flagging mailpieces having a meter impression bearing a value less than a predetermined value comprising the steps of:

providing a first and second indicia for printing in conjunction with a postal value, said second indicia being selectable for printing in place of said first indicia;

detecting that an amount to be printed is less than a predetermined value corresponding to a stored postal rate; and printing said amount less than a predetermined value in conjunction with said second indicia in place of said first indicia.

10. A postage metering system, comprising:

input means for inputting into said postage metering system a value of postage to be imprinted on a mail piece and a class of service for said mail piece;

means for storing data of an appropriate postage value amount for at least one class of service;

mechanical printing means including settable printing dies, said printing die having die protector means which are moveable between a first, a second and a third position, said printing means operable to imprint with said die protector means in said first position when said value of postage is equal to said appropriate postage; and for printing a different second postage imprint with said die protector means in said second position when said value of postage is other than said appropriate postage; and said printing means not operable to print a postage imprint with said die protector means in said third position.

11. A postage system as defined in claim 10 wherein said class of service and said postage is imprinted as part of said first postage imprint and said second postage imprint.

12. A postage metering system as defined in claim 10 wherein said second postage imprint is an imprint having at least one die protection mark imprinted along with said first postage imprint.

13. A postage metering system as in claim 10 wherein said second postage imprint includes a legend indicating a postage value which is other than said appropriate postage value for said class of service.

14. In a postage meter having a printing mechanism operative for printing postal value in a postal indicia and means for accounting for the printing of a value, the improvement comprising:

means for selectably printing one of a postal indicia and a low value indicia distinguishable from a postal indicia, means for detecting that the printing mechanism has been set to print a postal less than a predetermined value corresponding to a stored postal rate, and wherein said means for printing is operative to print the low value indicia whenever the printing means prints a postal value less than said predetermined value.

* * * * *